US005218733A

United States Patent [19]

Leu

[11] Patent Number: 5,218,733

[45] Date of Patent: Jun. 15, 1993

[54] PAINT BRUSH WITH RELEASABLE BRISTLES

[76] Inventor: James M. Leu, 159 Thornhurst, Bolingbrook, Ill. 60439

[21] Appl. No.: 783,405

[22] Filed: Oct. 28, 1991

[51] Int. Cl.[5] ..... A46B 5/02

[52] U.S. Cl. ..... 15/146; 15/178; 15/202

[58] Field of Search ..... 15/145, 146, 176.1, 15/176.6, 194, 202, 150, 178, 177, 176.5; 300/21

[56] References Cited

U.S. PATENT DOCUMENTS

| | | | |
|---|---|---|---|
| 134,745 | 1/1873 | Gorman | 15/177 |
| 389,657 | 9/1888 | Kimbler | 15/177 |
| 765,944 | 7/1904 | Tuttle et al. | 15/178 |
| 928,401 | 7/1909 | Potter | 300/21 |
| 1,033,272 | 7/1912 | Rowe | 15/194 |
| 1,071,320 | 8/1913 | Kiras | 15/177 |
| 1,478,213 | 12/1923 | Förisdal | 15/146 |
| 1,478,339 | 12/1923 | Jayne | 15/150 |
| 1,850,233 | 3/1932 | Herman | 15/194 |
| 1,917,747 | 7/1933 | Wozar | 15/146 |
| 3,874,021 | 4/1975 | Jacobs | 15/202 |
| 4,469,223 | 9/1984 | Smith | 15/176.1 |
| 4,890,350 | 1/1990 | O'Keefe, Jr. | 15/176.6 |

FOREIGN PATENT DOCUMENTS

| | | | |
|---|---|---|---|
| 557034 | 8/1923 | France | 15/150 |
| 1131276 | 10/1956 | France | 15/146 |
| 84110 | 2/1920 | Switzerland | 15/146 |
| 886285 | 1/1962 | United Kingdom | 15/202 |
| 928579 | 6/1963 | United Kingdom | 15/202 |

*Primary Examiner*—Harvey C. Hornsby
*Assistant Examiner*—Mark Spisich
*Attorney, Agent, or Firm*—Hill, Steadman & Simpson

[57] ABSTRACT

A paint brush or like structure, and method of making the same, in which bristles having a back binding the bristles into a permanent format are mounted on a handle and quick replaceably retained thereon with the bristles projecting usefully from the handle. The brush may be used by manipulating the handle, and the bristles can be readily removed and replaced. When removed, the bristles can be efficiently cleaned. The bristles and back can be supplied in a tape-like preformed strip from which the user can cut selected width panels for making up paint brushes of desired sizes and bristles density.

11 Claims, 2 Drawing Sheets

PAINT BRUSH WITH RELEASABLE BRISTLES

FIELD OF THE INVENTION

The present invention relates to bristle equipped brushes for applying paint or the like, and is more particularly concerned with brushes of this type having releasable bristles, and bristle means especially suitable for such brushes.

BACKGROUND OF THE INVENTION

Conventional paint brushes have the bristles or filaments bound by an epoxy or like back which is permanently attached to a handle as by means of a metal ferrule. After use, the brushes must be cleaned, preserved or discarded. All options except discarding the brushes are made difficult by the manner in which the filaments or bristles, of whatever kind, whether natural or man made, are fixed to the handle. The dense collections of bristles resist cleaning because of the manner in which the densely clustered bristles are permanently held to the handle at their back by the ferrule. As a result, many paint brushes are used only a few times, even after attempts at cleaning, and then discarded because of the hardening of residual paint in the bristles starting adjacent the bristle back.

With conventional paint brushes, where users have need for brushes of different sizes, they must acquire individual brushes for the sizes desired.

By the term "paint brush(es)" is meant any brush having conventional paint brush configuration, although the brush may be used as an applicator for any other fluent material

SUMMARY OF THE PRESENT INVENTION

An important object of the present invention is to provide a new and improved brush construction in which the back-bound bristles are readily separable from the brush handle for exchange or cleaning.

Another object of the invention is to provide a new an improved paint brush construction in which a single brush handle may be selectively equipped with bristle masses of various densities and brush sizes and in an easily replaceable manner.

A further object of the invention is to provide new and improved brush means for effecting replaceable brush assemblies conveniently and economically Still another object of the invention is to provide a new and improved method of assembling paint brushes according to various optional user requirements.

Pursuant to the principles Of the present invention, there is provided a paint brush, and method of making the same, comprising bristles having a back binding the bristles into a permanent format, a handle having a head adapted to receive the back, and means for quick-replaceably retaining the back on the handle head with the bristles projecting usefully from the handle. This enables use of the brush by manipulating the handle, and the bristles can be readily removed and replaced.

There is also provided new and improved tape-like preformed paint brush bristle means enabling a user to cut selected width panels for making up paint brushes of desired sizes and bristle density.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DETAILED DESCRIPTION OF PREFERRED EMBODIMENTS OF THE INVENTION

Figure 1:
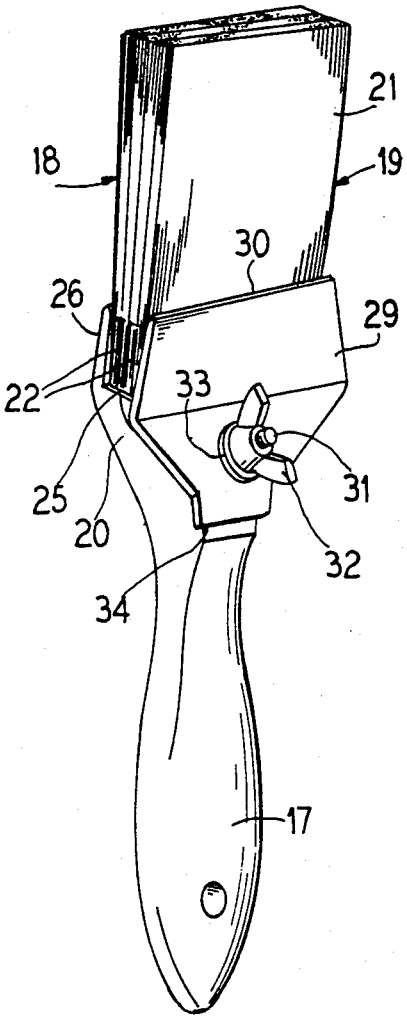
FIG. 1 is a perspective view of a paint brush embodying the present invention.
Figure 2:
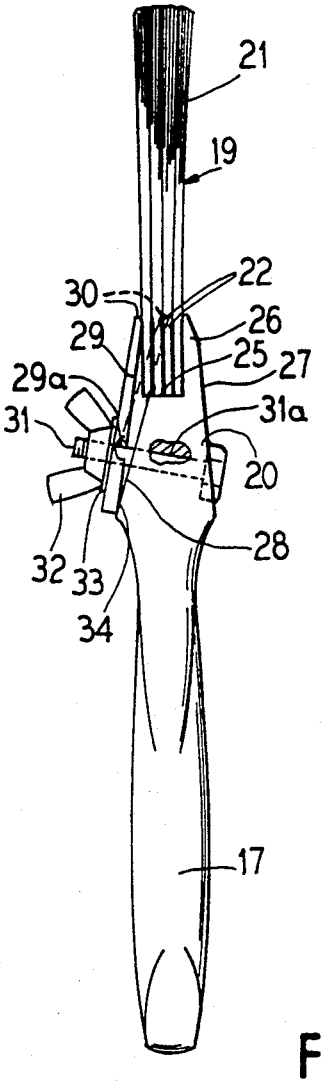
FIG. 2 is a side elevational view of the brush in FIG. 1.
Figure 3:
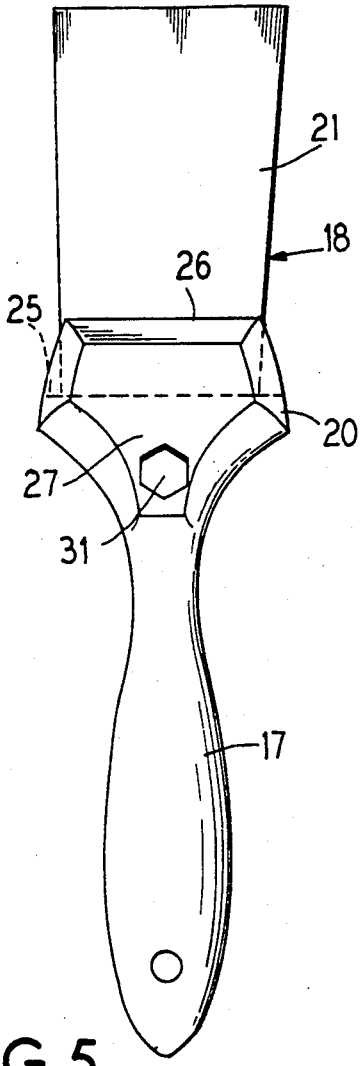
FIG. 3 is a rear elevational view of the brush in FIG. 1.
Figure 4:
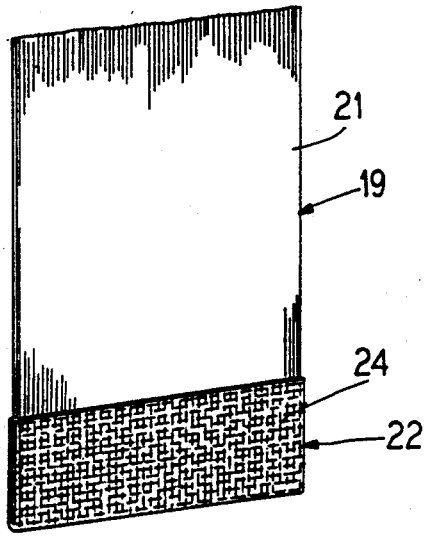
FIG. 4 is a perspective view of a replaceable bristle bundle or unit as used in the brush of FIG. 1.
Figure 5:
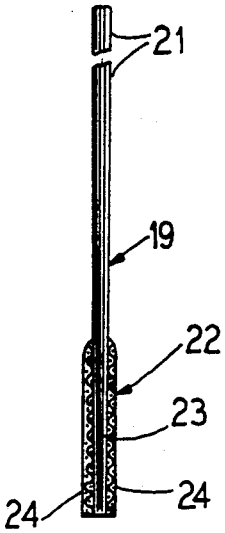
FIG. 5 is an edge elevational view of the bristle unit of FIG. 4.

In one best mode embodiment of the invention as shown in FIGS. 1-3, a paint brush 15 comprises a handle 17 carrying a bristles 18. In this instance, the bristles 18 comprise a plurality of bristle panels 19 (see FIGS. 4 and 5) clamped replaceably onto a preferred width and thickness head portion 20 of the handle 17.

For convenient handling, each of the bristle panels 19 comprises a flat permanent assembly of bristles 21 of any preferred bristle type and density, bound by a back 22 in the form of a flat body 23 of suitable plastic, such as an epoxy. To assure stability and resist separation, the plastic body 23 is permanently faced at least on one side and preferably on both sides by reinforcing means, such as open mesh, scrim, molded or punched plastic or metallic, such as aluminum, strip means 24. The back 22 is desirably Waterproof and solvent proof so as to permit efficient cleaning of the panel 19 after use. Each of the panels 19 is of any width and height or length and thickness suitable for the type and size of brush 15 desired.

As best seen in FIGS. 1 and 2, the handle head 20 is constructed and arranged to permit one or a plurality of the brush panels 19 to be mounted thereon and clamped in place. For this purpose, the brush head 20 has, extending along its width, an upwardly facing shoulder 25 with an upstanding rigid lip 26 extension of one face 27 of the head and providing a back-rest along one side of the shoulder. The shoulder 25 is of a width to receive up to a preferred number of the brush panels 19, four as shown, in face-to-face assembly.

An opposite face 28 of the handle head 20, extends obliquely downwardly from the free longitudinal side edge of the shoulder 25 and provides an area for receiving a clamping plate 29 having an upper edge 30 extending to a height about the same as the height of the backrest lip 27. By clampingly thrusting the plate 29 toward the lip 27, any number from one to a plurality of the brush backs 22 can be clamped against the lip 27 for thereby securing the bristle panels 19 in place.

For clampingly maneuvering the plate 29, a headed thumb screw 31 is carried by the handle head 20 with its shank extending through an appropriate screw clearance hole 31*a* in the head 20, and a matching hole 29*a* in the butt and portion of the plate 29, so that a thumb nut 32 and washer 33 are adapted to be driven against the plate 29 by threaded manipulation of the thumb nut. Upon tightening the thumb nut 32 against the plate 29, the plate is caused to rock on a fulcrum 34 at the lower end of the brush head area 28 so as to cause the gripping edge 30 of the plate 29 to thrust securingly toward the brush back or backs 22. By having the upper edges of the brush backs 22 at a height such that the gripping edge 30 thrust generally theretoward maximum gripping engagement is attained. Slippage of the brush panels 19 relative to one another or relative to the lip 26 or relative to the clamping edge 30 is avoided by having the brush backs 22 of inherently frictional character.

When the user wishes to make use of the paint brush 15, he loads a selected number from one to four of the brush panels 19 onto the shoulder 25 and clampingly tightens the manipulatable plate 29 to secure the brush panels in place.

Figure 12:
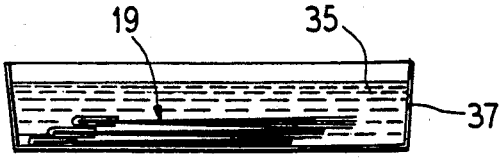
FIG. 12 is a schematic illustration of means for after-use cleaning the bristle masses, units or panels removed from a brush handle.

After use, such as for painting, or for applying any other feasible fluent material, the brush panels 19 can be readily removed by unclamping the plate 29 and lifting or dumping the panels from the brush handle and placing them in a solvent for cleaning. As exemplified in FIG. 12, solvent 35 in a pan 37 is adapted to receive the brush panels 19 that require cleaning. This is a convenient manner of thoroughly cleaning the brush panels, which can be easily manipulated to work the solvent 35 in and among the bristles for maximum cleaning effect, and without interferences of the handle 15. While the brush panels 19 are soaking in the cleaning solution for cleaning as described, the handle 15 can be immediately reused by mounting replacement brush panels 19 thereon.

It may also be observed that although as shown in FIGS. 1-3, the brush panels 19 are of substantially the same width as the brush head, the brush panels may be of any lesser width desired to provide selective narrower brush widths. For example, if a brush of half width is desired, brush panels 19 of half width may be substituted. If a tapered edge brush is desired, panels having differing height bristles may be clamped in cooperative relation.

Figure 6:
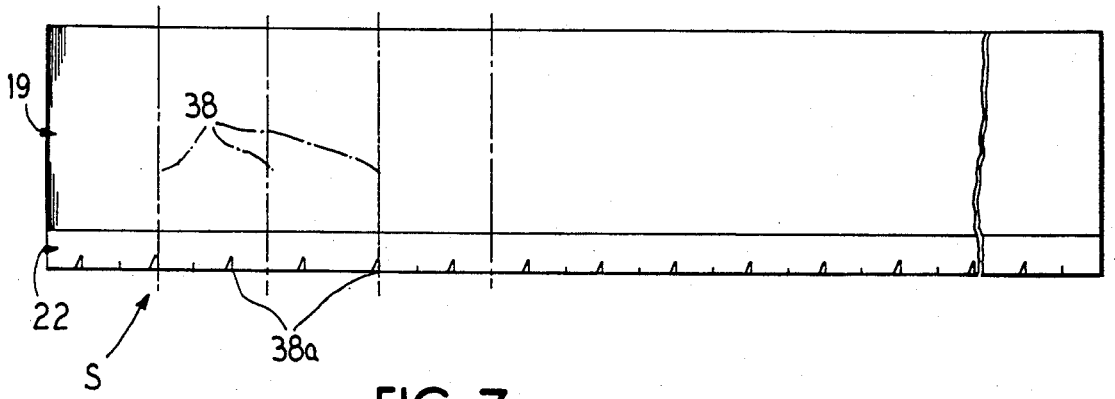
FIG. 6 is a tape arrangement of bristles adapted for selective paint brush arrangements.

A convenient manner of supplying the brush panels 19 is in a continuous tape-like strip S as shown in FIG. 6, and from which strip the desired widths of brush panels can be selectively cut as by means of a scissor or other cutting tool for shearing the brush back 22 of the strip. For example, lines 38 indicate separation of panels from the strip S to obtain the four brush panels 19, as utilized in connection with the brush 15 shown in FIG. 1. Index marks 38*a* may be provided at convenient intervals along the back 22 of the strip S to facilitate cutting the strip into panels of selected widths.

Figure 7:
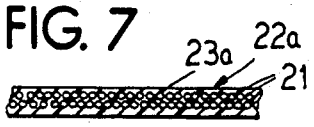
FIG. 7 is a fragmental enlarged sectional detail view showing a modified bristle back.

FIG. 7 shows in detail how the brush back 22*a* may be constructed, using only a suitable plastic binder 23*a* to secure the bristles 21 along the back 22*a*. For best results, the structure of the back 22 is reasonably flexible to adapt to handling, so that the strip S may be supplied in a roll if desired, and also to facilitate manipulation when cleaning the brush panels 19.

Figure 10:
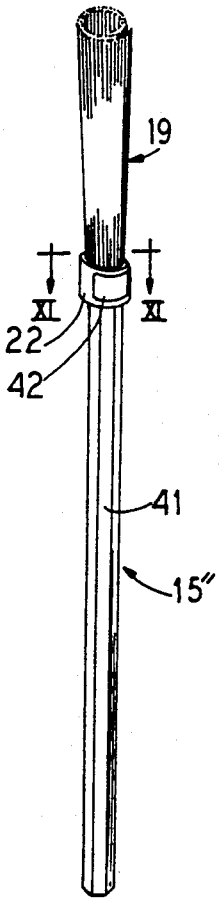
FIG. 10 is a perspective view of a further optional form of brush adapted to be made from the tape of FIG. 6.
Figure 8:
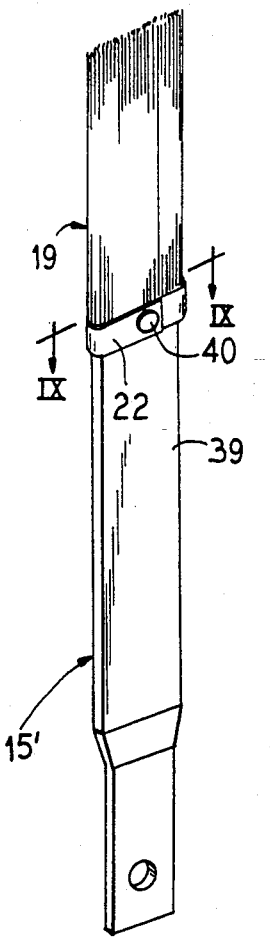
FIG. 8 is a perspective view of another optional form of paint brush adapted to be made from the bristle tape of FIG. 6.
Figure 9:
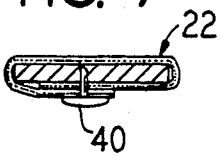
FIG. 9 is a fragmentary sectional detail view taken substantially along the line IX—IX in FIG. 8.
Figure 11:
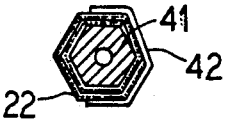
FIG. 11 is an enlarged fragmentary sectional detail view taken substantially along the line XI—XI in FIG. 10.

Another advantage of having the backs 22 of the brush bristle panels 19 flexible is that, if desired, a paint brush 15' (FIG. 8) may be constructed by wrapping one or more of the bristle panels 19 about the upper end of a handle 39. This handle 39 may be formed from wood or plastic and, as shown, comprise a flat cross section and be of any length desired. After wrapping the bristle panel, or panels whether connected or not, about the upper end portion of the handle 39, suitable means such as a thumb tack 40 or similar fastener may be used to secure the base or back 22 of the bristle panel or panels 19 in place on the handle. This permits formation of a brush of any desired density having regard to the density of the bristles in the bristle panel structure and the extent of winding overlap of the panel structure. After use, it is a simple matter to remove the fastener 40 and clean the bristle panel structure.

Where a generally columnar brush 15" (FIGS. 10 and 11) is desired, an elongated columnar handle 41 is adapted to have one or more of the bristle panels 19 wrapped tightly about its head portion, and with suitable means, shown as a strip of adhesive tape 42 or the like securing the back 22 firmly onto the handle. By virtue of its frictional structure, the back 22 resists pulling it off of the handle, as well as resisting rotating slippage about the handle. By having the handle of an out-of-round, such as hexagonal cross section anchorage of the tightly wound back 22 is enhanced. When it is desired to remove the bristle mass from the handle 41, it is a simple matter to strip the retaining tape 42 and thereby release the bristle mass from the handle.

It will be apparent that various modifications and/or additions may be made in practice of the invention without departing from the essential feature of novelty involved, which are intended to be defined and secured by the appended claims.

I claim as my invention:

1. A paint brush assembly, comprising:

bristles having a back binding the bristles into a permanent panel;

a handle having a longitudinal axis, and a head at one end of the handle for supporting said bristle panel replaceably;

said handle head having an axially facing shoulder in a plane normal to said axis;

an angular axially extending rest lip on said head along one side of said shoulder;

said bristle panel back resting on said shoulder with said bristles extending axially;

a clamping plate having a fulcrum edge engaging a fulcrum on said handle head spaced from said shoulder;

a gripping edge on said plate extending over said shoulder and engaging said bristle panel back for clamping said bristle panel back against said lip when said plate is fulcrummed toward said lip;

means for retaining said plate in place on said handle head and for effecting rocking of said plate about said fulcrum for thrusting said gripping edge against said bristle panel back for clamping said back against said lip;

an oblique surface on said handle head extending in clearance relation behind said plate from a free side edge of said shoulder to said fulcrum;

a thumb screw having a shank extending through a hole in said handle head and said oblique surface and through a matching screw clearance hole in said plate, a head on one end of said shank engaging a surface of the handle head at an entrance to said hole in said head at the side of said handle head opposite said oblique surface, and a nut threaded on an opposite end portion of said shank and bearing against said plate for effecting said thrusting of said gripping edge clampingly against said bristle panel back and toward said lip;

said bristle panel back having about the same length as the length of said lip; and a plurality of said bristle panels cooperating to provide a predetermined bristle density for the brush.

2. A brush according to claim 1, wherein each bristle panel back for each of the bristle panels has a permanent open mesh reinforcing means selected from scrim strip, molded or punched plastic strip and metallic strip such as aluminum.

3. A brush according to claim 2, wherein said panels comprise sections of predetermined width cut from a continuous strip of bristle panel material having a continuous brush back area therealong.

4. A brush assembly according to claim 3, wherein said bristle panel strip has index marks at convenient intervals along said brush back area to facilitate cutting the strip into panels of selected widths.

5. A paint brush assembly, comprising:

bristles having a back binding the bristles into a permanent panel;

a handle having a longitudinal axis, and a head at one end of the handle for supporting said bristle panel replaceably;

said handle head having an axially facing shoulder in a plane normal to said axis;

an angular axially extending rest lip on said head along one side of said shoulder;

said bristle panel back resting on said shoulder with said bristles extending axially;

a clamping plate having a fulcrum edge engaging a fulcrum on said handle head spaced from said shoulder;

a gripping edge on said plate extending over said shoulder and engaging said bristle panel back for clamping said bristle panel back against said lip when said plate is fulcrummed toward said lip; and said bristle panel back having a permanent open mesh reinforcing means selected from scrim strip, molded or punched plastic strip, and metallic strip such as aluminum.

6. A brush assembly according to claim 5, wherein said bristle panel comprises a panel section of predetermined width cut from a continuous strip of bristle panel material.

7. A brush assembly according to claim 6, wherein said panel strip has index means at convenient intervals on a continuous length of bristle back along said strip to facilitate separating the strip into panels of selected widths.

8. A brush assembly according to claim 7, wherein said index means comprises index marks along a free edge of said bristle back.

9. A brush assembly according to claim 5 including means for retaining said clamping plate in place on said handle head and for effecting rocking of said plate about said fulcrum for thrusting said gripping edge toward said lip.

10. A brush assembly according to claim 9, including an oblique surface on said handle head extending in clearance relation behind said plate from a free side edge of said shoulder to said fulcrum.

11. A brush assembly according to claim 10, wherein a thumb screw has a shank extending through a hole in said handle head and said oblique surface and through a matching screw clearance hole in said plate, a head on one end of said shank engaging a surface of the handle head at an entrance to said hole in said head at the side of said handle head opposite said oblique surface, and a nut threaded on an opposite end portion of said shank and bearing against said plate for effecting said thrusting of said gripping edge clampingly toward said lip.

* * * * *